US009309787B2

(12) United States Patent
Rasmussen et al.

(10) Patent No.: US 9,309,787 B2
(45) Date of Patent: Apr. 12, 2016

(54) ENGINE ROCKER ARM AND ROLLER ASSEMBLY

(71) Applicant: Electro-Motive Diesel, Inc., LaGrange, IL (US)

(72) Inventors: Laura Rasmussen, Brookfield, IL (US); Adarsh Nair, Darien, IL (US); Mathias Klemp, LaGrange, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 14/319,741

(22) Filed: Jun. 30, 2014

(65) Prior Publication Data

US 2015/0377082 A1 Dec. 31, 2015

(51) Int. Cl.

| | |
|---|---|
| ***F01L 1/18*** | (2006.01) |
| ***F01L 1/047*** | (2006.01) |
| ***F01L 1/46*** | (2006.01) |

(52) U.S. Cl.

CPC ..... *F01L 1/181* (2013.01); *F01L 1/047* (2013.01); *F01L 1/46* (2013.01)

(58) Field of Classification Search

CPC ..... F01L 1/181; F01L 1/047; F01L 1/46
USPC ..... 123/90.39
See application file for complete search history.

(56) References Cited

U.S. PATENT DOCUMENTS

| | | | |
|---|---|---|---|
| 5,273,005 | A | 12/1993 | Philo et al. |
| 5,823,154 | A | 10/1998 | Kuhn et al. |
| 6,164,109 | A | 12/2000 | Bartosch |
| 6,220,758 | B1 | 4/2001 | Ono et al. |
| 6,289,765 | B1 | 9/2001 | Clayson, III |
| 6,341,587 | B1 | 1/2002 | Speil et al. |
| 7,431,508 | B2 | 10/2008 | Piraner et al. |
| 7,721,696 | B2 | 5/2010 | Evans et al. |
| 2008/0271693 | A1 | 11/2008 | Edelmayer et al. |

*Primary Examiner* — Zelalem Eshete

(57) ABSTRACT

An engine rocker arm and roller assembly is disclosed which may include a rocker arm having a first end and a second end, with a rocker arm being adapted to pivot about a pivot aperture therein. The engine rocker arm and roller assembly may further include an axle mounted in the second end with the axle being made of bronze and having a stepped profile. The roller may be rotatively mounted to the axle.

18 Claims, 3 Drawing Sheets

ENGINE ROCKER ARM AND ROLLER ASSEMBLY

FIELD OF THE DISCLOSURE

The present disclosure generally relates to engines and, more particularly, relates to rocker arm and roller assemblies used in engines.

BACKGROUND OF THE DISCLOSURE

In the manufacture and operation of engines such as diesel engines and Otto cycle internal combustion engines, it is well known to employ a cam shaft to coordinate the timing of valve opening and closing and to inject fuel. For example, with a diesel engine, an engine block is provided having a plurality of cylinders therein. A plurality of pistons are reciprocatingly mounted within each of the cylinders with a plurality of valves associated with each the cylinders to allow for inflow and outflow of air. In order to coordinate the timing of those valve openings, each valve is typically in forced contact with one end of a rocker arm or cam follower. This is typically accomplished with a push rod or other components comprising the valve train. The rocker arm itself is pivotally mounted relative to the engine block. One end of the rocker arm is provided with a rotating element called a roller which engages cams mounted on the cam shaft. Each cam is eccentrically formed so that rotation of the cam shaft causes larger and smaller diameter portions of each cam to rotate and in turn cause the rocker arm to pivot, thus opening and closing the valves and/or engaging a fuel injector plunger, as appropriate.

While effective, for such structure to operate effectively and consistently, the roller needs to be able to freely rotate at all times. Any inhibition or prevention of such rotation detrimentally affects the operation of the engine. If the roller were to seize on the rocker arm, for example, operation of the engine may be even more affected thus resulting in catastrophic failure.

With some rocker arms, the roller is mounted to the rocker arm using a complicated assembly of components. More specifically, an internal pin or axle extends between first and second sides of the rocker arm with an inner race being rotatively mounted to the pin. A bushing is then provided around the inner race with the roller itself then being mounted onto the bushing. Given the relatively small dimensions of such components, the assembly and manufacture of such a device is fairly complicated. Moreover, given the tight tolerances between the components, the bushing and inner race must be press fit together also adding to the difficulty and manufacturing cost associated with such a rocker arm assembly. In addition, such an assembly typically employs a lead tin overlay which adds to the complexity and cost of the assembly as well.

From the foregoing, it can be seen that a need exists for an improved rocker arm and roller assembly.

SUMMARY OF THE DISCLOSURE

In accordance with one aspect of the disclosure, an engine rocker arm and a roller assembly is therefore disclosed which may comprise a rocker arm having a first end and a second end with the rocker arm adapted to pivot about a pivot aperture therein, an axle mounted in the second end with the axle having a stepped profile, and a roller rotatably mounted directly to the axle.

In accordance with another aspect of the disclosure, an axle for use in a rocker arm and roller assembly of an engine is disclosed which may comprise a first cylindrical section having a first diameter, a second cylindrical section adjacent to and integral with the first cylindrical section, the second cylindrical section having a lesser diameter than the first cylindrical section, and a third cylindrical section adjacent to and integral with the second cylindrical section, the third cylindrical section having a lesser diameter than the second cylindrical section.

In accordance with another aspect of the disclosure, an engine is disclosed which may comprise an engine block having a plurality of cylinders, a plurality of pistons reciprocatingly mounted in a plurality of cylinders, a plurality of valves operatively associated with the plurality of cylinders, a cam shaft rotating relative to the engine block and including a plurality of cams, a plurality of rocker arms with each rocker arm being operatively associated with one of the plurality of cams and one of the plurality of valves, an axle press fit into each rocker arm, and a roller mounted directly to each axle, each axle having a stepped profile and being manufactured with bronze.

These and other aspects and features of the disclosure will become more readily apparent upon reading the following detailed description when taking into conjunction the accompanying drawings.

While the present disclosure is susceptible to various modifications on alternative constructions, certain illustrative embodiments thereof will be shown and described below in detail. However, it is to be understood that the disclosure is not limited to the specific embodiments disclosed, but instead includes all modifications, alternative constructions, and equivalents thereof.

DETAILED DESCRIPTION

Figure 1:
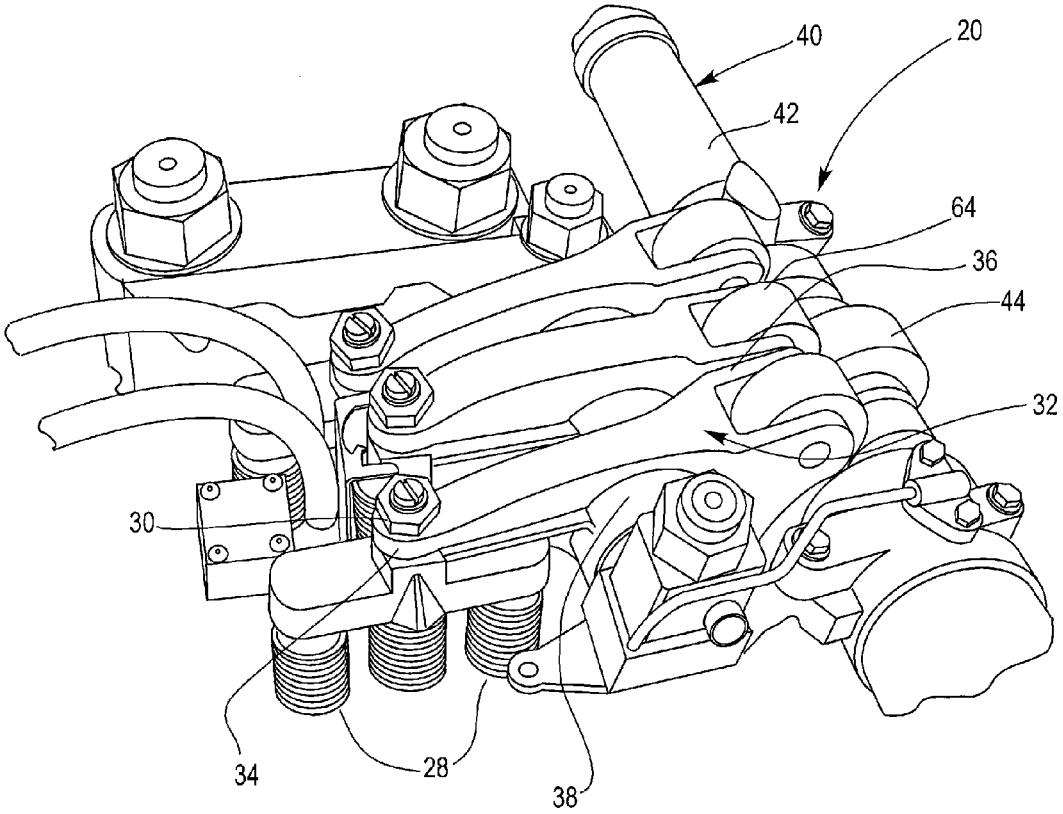
FIG. 1 is a perspective view of an engine constructed in accordance with the teachings of the disclosure.

Referring now to the drawings, and with specific reference to FIG. 1, an engine constructed in accordance with the teachings of the present disclosure is generally referred to by reference numeral 20. While the following detailed description will be made with reference to the engine 20 being a diesel engine, it is to be understood that the teachings of this disclosure can be employed with equal efficacy in connection with other types of engines, including but not limited to, Otto cycle internal combustion engines as well.

While not specifically depicted, one of ordinary skill in the art will appreciate that the engine 20 of FIG. 1 includes an engine block having a plurality of cylinders therein, and a plurality of pistons reciprocatingly mounted in the cylinder. A plurality of valves 28 are also provided, each one of which is operatively associated with one of the aforementioned cylinder and piston pairs. In order to open and close the valves 28 at the appropriate time in the engine cycle, each valve 28 is connected by way of a valve bridge 30 to a rocker arm 32. The rocker arm 32 includes a first end 34 and an opposite second end 36. Moreover, the rocker arm 32 is adapted to pivot about a pivot axis 38.

The rocker arm 32 is caused to so pivot by the engagement of the second end 36 of the rocker arm 32 with a camshaft 40. As will be noted in FIG. 1, the camshaft 40 includes a cylindrical shaft 42 to which a plurality of eccentrically formed cams 44 are attached. As the shaft 42 rotates, so do the cams 44, and depending upon the particular point on the circumference of the cam 44, the diameter of the cam 44 changes. The rocker arm 32 is thus in turn caused to pivot away from or toward the cam shaft 42. This causes the valve bridge 30 to move downwardly or upwardly, thereby opening or closing the valve 28. As the cam shaft 40 continues to rotate, the cam 44 moves to a smaller diameter section of its circumference thereby allowing the rocker arm 32 to pivot in the opposite direction relative to the cam shaft 40, thus lifting or lowering the valve bridge 30 and thus closing or opening the valve 28.

Figure 2:
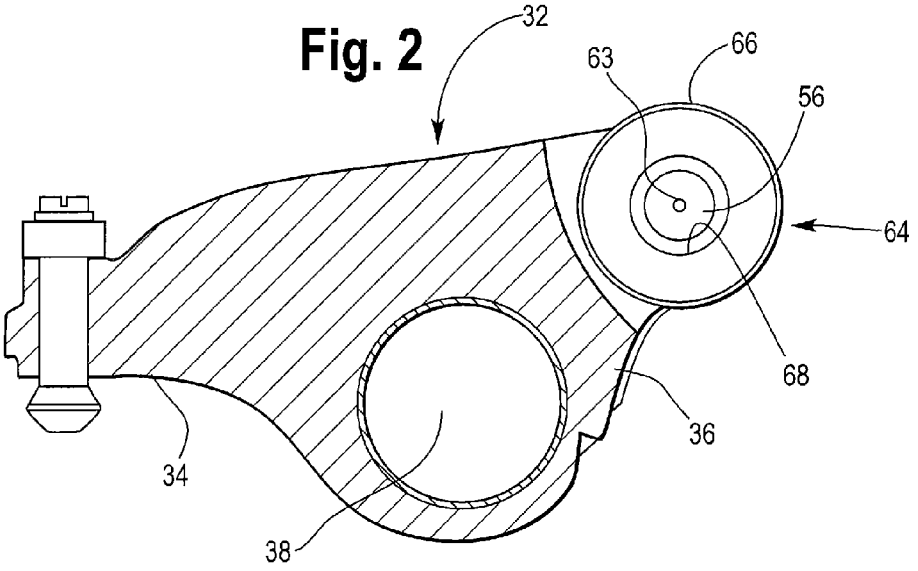
FIG. 2 is a side view of a rocker arm roller assembly constructed in accordance with the teachings of the disclosure.
Figure 3:
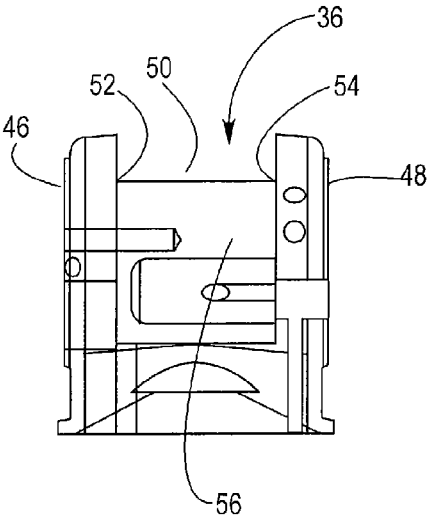
FIG. 3 is an end view of the rocker arm roller assembly of FIG. 2.

Referring now to FIG. 2, the rocker arm 32 is shown in further detail. As indicated above, the rocker arm 32 includes the aforementioned first end 34 and opposite second end 36 both of which flank the pivot axis 38. With respect to the second end 36, which is shown in even further detail in the end view of FIG. 3, it includes first and second lateral sides or ears 46, 48 forming a gap 50 therebetween. Moreover, the lateral side 46 includes a first aperture 52, while the second side 48 includes a second aperture 54. The first and second aperture 52, 54 are concentric, but as will be noted in FIG. 3, include different diameters. More specifically, the first aperture 52 has a larger diameter than the second aperture 54.

Figure 4:
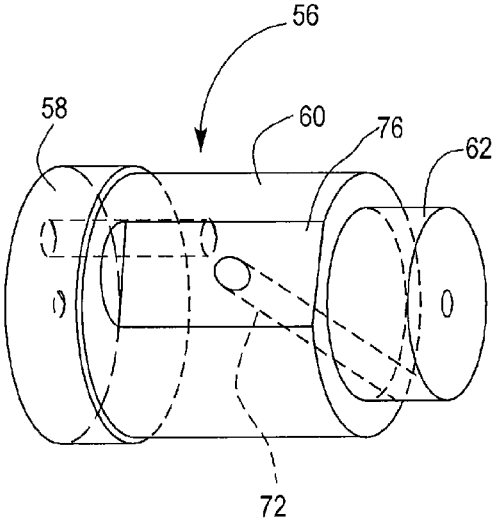
FIG. 4 is a perspective view of an axle constructed in accordance with the teachings of the disclosure.

Between the first and second lateral sides 46, 48, spans an axle 56. The axle 56 is sized so as to be press fit into the rocker arm 32 and more specifically, into the first and second apertures 52, 54. Turning now to FIG. 4, the axle 56 is shown in greater detail to include three distinct cylindrical sections connected in stepped fashion: a first cylindrical section 58, a second cylindrical section 60, and a third cylindrical section 62. As will be noted, the second cylindrical section 60 is adjacent to, and integral with, the first cylindrical section 58; and similarly the third cylindrical section 62 is adjacent to, and integral with, the second cylindrical section 60. In other words, the axle 56 is formed of an integral piece of material. That specific type of material is of import and will be discussed in further detail herein.

The diameters of the first, second and third cylindrical sections 58, 60, 62 are also of importance. More specifically, the first cylindrical section 58 includes a diameter slightly less than the diameter of the first aperture 52 so as to be press fit therein, and be held within the rocker arm by way of friction. Similarly, the third cylindrical section 62 is slightly less than the diameter of the second aperture 54 so as to be press fit and frictionally held within the second aperture 54.

Once press fit within the second end 36 of the rocker arm 32, the second cylindrical section 60 spans between the first and second lateral sides 46, 48 to form a pivot axis 63 for a roller 64 to rotate there about. It is the roller 64 which directly engages the cams 44 of the cam shaft 40 as mentioned above. The roller 64 itself includes an outer circumference 66 for direct engagement of the camshaft 40, and an inner circumference 68 for direct engagement with the axle 56. Among other things, by manufacturing the axle 56 with such a stepped configuration instead of a straight cylinder, a large bearing surface is provided, while stress is reduced in one of the rocker arm ears.

In so doing, it can be seen that the present disclosure greatly improves upon the prior art which employs a complicated structure using an interior pin, an inner race, an outer bushing, and a roller. As each of those aforementioned prior art components needed to be press fit and manufactured to exacting dimensions, they were relatively difficult to manufacture and thus costly as well. Moreover, given the very small tolerances between the components, the components may tend to seize in use, thus detrimentally or catastrophically affecting engine operation. With the present disclosure on the other hand, construction in streamlined, and maintenance and operability are enhanced using fewer parts. Moreover, the present disclosure can be used with existing rocker arms with limited retrofit adjustments.

Referring again to FIG. 4, it can be seen that the axle 56 includes a lubrication channel. The lubrication channel 72 extends from the third cylindrical section 62 into the second cylindrical section 60. The lubrication channel 72 feeds lubrication to the roller 64 and cams 44 via a flat 76 which serves as a manifold to distribute lubrication from the engine 20. The lubrication channel 72 of course in turn is connected to a source of lubrication (not shown) so as to keep the axle 56 and the roller 64 adequately lubricated and thus movable at all times.

As referenced above, the axle 56 is manufactured from a specific material to allow for such ease of rotation, manufacturability and durability. While a number of different materials can be used for manufacturing the axle 56, the inventors have found that bronze forms a suitable surface for such operation. Moreover, the entire axle 56 may be manufactured from bronze. By manufacturing the entire axle 56 from a single material, the need for overlays such as lead tin overlays associated with prior art axles can be avoided. This in turn eases the manufacturability of the assembly. While the axle 56 may be made of bronze, the roller 64 may be made of steel so as to withstand the repeated loading thereof.

Figure 5:
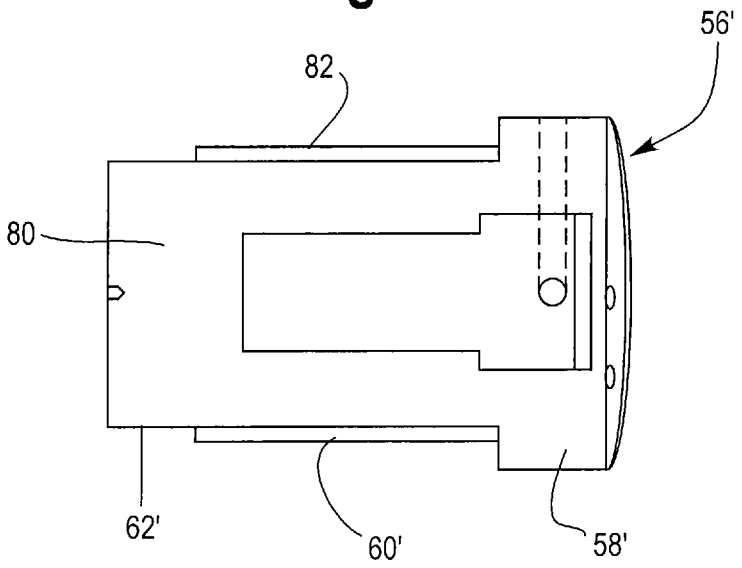
FIG. 5 is a perspective view of an alternative embodiment of an axle constructed in accordance with the teachings of the disclosure.
Figure 6:
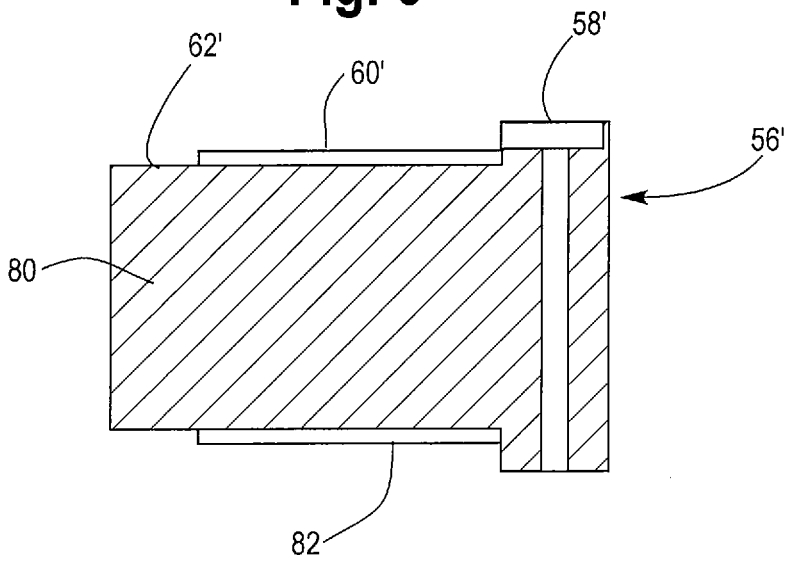
FIG. 6 is a sectional view of the axle of FIG. 5.

Turning now to FIGS. 5 and 6, an alternative embodiment of an axle 56' is shown. FIG. 5 depicts the axle 56' in perspective, while FIG. 6 depicts the axle 56' in longitudinal cross-section. As will be noted, the axle 56' is still manufactured with a stepped profile having first, second and third cylindrical sections 58', 60', 62'. However, as opposed to the first embodiment which manufactures the entire axle 56 from bronze, in the alternative embodiment, the axle 56' is manufactured of a steel base 80 onto which a bronze layer 82 is cast.

INDUSTRIAL APPLICABILITY

In operation, it can be seen that the present disclosure sets forth a rocker arm and roller assembly for use in a diesel or other engine which has a greatly improved axle and roller operation and manufacturability. As opposed to prior art devices which employ a complicated assembly of a pin, outer race, bushing, and a roller manufactured of specific materials and exacting dimensions, all of which need to be press fit together, the pending disclosure provides a greatly simplified approach which leads to less cost, easier manufacturing, and better durability. It does so by manufacturing the rocker arm with a roller end having first and second lateral sides, each of which include an aperture but of different diameters. In addition, the assembly employs a stepped axle which is adapted to be directly press fit into such apertures. By manufacturing the axle of distinctly diametered sections, the axle can be directly press fit into the roller end and form a rotational pivot for the roller without the need for any inner races, or bushings. Moreover, by manufacturing the axle from bronze, and the roller from steel, the consistent rotatability of the assembly is ensured.

What is claimed is:

1. An engine rocker arm roller assembly, comprising:

a rocker arm having a first end and a second end, the rocker arm adapted to pivot about a pivot aperture therein, wherein the rocker arm second end includes first and second concentric apertures, the first aperture being larger than the second aperture;

an axle mounted in the second end, the axle having a stepped profile; and a roller rotatably mounted directly to the axle.

2. The engine rocker arm roller assembly of claim 1, wherein the axle has first, second and third sections, each of a different diameter.

3. The engine rocker arm roller assembly of claim 1, wherein the first section of the axle is press fit directly into the first aperture of the rocker arm second end.

4. The engine rocker arm roller assembly of claim 3, wherein the third section of the axle is press fit directly into the second aperture of the rocker arm second end.

5. The engine rocker arm roller assembly of claim 1, wherein the axle is made entirely of bronze.

6. The engine rocker arm roller assembly of claim 5, wherein the axle includes at least one lubrication channel.

7. The engine rocker arm roller assembly of claim 1, wherein the roller is adapted to rotate against a cam shaft.

8. The engine rocker arm roller assembly of claim 1, wherein the first end of the rocker arm is adapted to open and close an engine valve.

9. An axle for use in a rocker arm roller assembly of an engine, the axle comprising:

a first cylindrical section having a first diameter;

a second cylindrical section adjacent to and integral with the first cylindrical section, the second cylindrical section having a lesser diameter than the first cylindrical section; and a third cylindrical section adjacent to and integral with the second cylindrical section, the third cylindrical section having a lesser diameter than the second cylindrical section.

10. The axle of claim 9, wherein the first, second and third cylindrical sections are all made of bronze.

11. The axle of claim 9, wherein the first, second and third cylindrical sections are made of a steel base with a bronze layer cast thereon.

12. The axle of claim 11, further including a lubrication channel and lubrication flat.

13. An engine, comprising:

an engine block having a plurality of cylinders;

a plurality of pistons reciprocatingly mounted in the plurality of cylinders;

a plurality of valves operatively associated with the plurality of cylinders;

a cam shaft rotatable relative to the engine block and including a plurality of cams;

a plurality of rocker arms with each rocker arm being operatively associated with one of the plurality of cams and one of the plurality of valves and wherein each rocker arm includes first and second ends, the second end including first and second concentric and spaced apertures;

an axled press fit into each rocker arm; and a roller mounted directly to each axle, each axle being manufactured with bronze and having a stepped profile.

14. The engine of claim 13, wherein each axle is made entirely of bronze.

15. The engine of claim 13, wherein each axle is made of a steel base with a bronze layer cast thereon.

16. The engine of claim 15, wherein each stepped cylinder includes first, second and third sections, each of different diameters.

17. The engine of claim 13 wherein the first section of the axle has the largest diameter and is press fit directly into the first aperture of the rocker arm.

18. The engine of claim 17, wherein the third section of the axle has the smallest diameter and is press fit directly into the second aperture of the rocker arm.

* * * * *